United States Patent [19]

Plater

[11] Patent Number: 4,508,281

[45] Date of Patent: Apr. 2, 1985

[54] HYDRAULIC DRIVE SYSTEM FOR CABLE STRINGING APPARATUS

[75] Inventor: Robert J. Plater, Shreveport, La.

[73] Assignee: TSE International, Shreveport, La.

[21] Appl. No.: 523,649

[22] Filed: Aug. 15, 1983

[51] Int. Cl.[3] ..... B65H 59/38; B66D 1/50

[52] U.S. Cl. ..... 242/54 R; 254/134.3 R; 254/274; 254/361

[58] Field of Search ..... 242/54 R, 86.5 R, 86.51; 254/274, 361, 134.3 R

[56] References Cited

U.S. PATENT DOCUMENTS

| | | | |
|---|---|---|---|
| 2,703,218 | 3/1955 | Haskell et al. | 254/134.3 |
| 2,763,467 | 9/1956 | Doolittle et al. | 254/274 X |
| 2,948,483 | 8/1960 | Petersen | 242/54 R |
| 3,037,720 | 6/1962 | Leithiser, Jr. . | |
| 3,073,574 | 1/1963 | Garnett . | |
| 3,161,022 | 12/1964 | Sandoy | 254/274 X |
| 3,381,939 | 5/1968 | Brown et al. | 254/361 X |
| 3,499,286 | 3/1970 | Reischl | 254/274 X |
| 3,658,270 | 4/1972 | Slator et al. | 242/54 R |
| 3,817,033 | 6/1974 | Appel et al. | 254/361 X |

*Primary Examiner*—John M. Jillions

*Attorney, Agent, or Firm*—Hubbard, Thurman, Turner & Tucker

[57] ABSTRACT

A rotary drum cable winding apparatus particularly adapted for constant tension pulling operations in conjunction with stringing aerial electrical cables includes a hydraulic drive and control system utilizing a variable displacement, variable torque hydraulic motor supplied by a pressure compensated hydraulic pump. The motor has a built-in displacement control which is responsive to a predetermined pressure set point which may be varied by a pilot control pressure signal to increase motor displacement per revolution and output torque for a given motive fluid supply pressure. The increasing torque requirements and the reduced rotative speed of the rotary drum coincide with the requirement for relatively constant tension and constant speed of the messenger line or cable being wound on the drum. A proportional pressure relief valve is in circuit with a pilot control pressure line and with the motive fluid supply line to the motor to automatically adjust the pressure set point at which motor displacement and torque output are controlled as a result of setting the maximum or limit pressure on the pressure compensated pump. Pressure setting changes for various maximum line tension settings may be set by adjusting a pressure relief valve in circuit with the pump displacement control.

9 Claims, 3 Drawing Figures

HYDRAULIC DRIVE SYSTEM FOR CABLE STRINGING APPARATUS

BACKGROUND OF THE INVENTION

Field of the Invention

The present invention pertains to a hydraulic drive system for a rotary drum type cable stringing apparatus wherein substantially constant tension is maintained in a cable as it is wound on the cable drum.

BACKGROUND

In the art of cable winding apparatus one preferred type of equipment comprises a relatively large rotary drum which is adapted to be rotatably driven to wind a messenger line or other flexible cable onto the drum while trying to maintain substantially constant tension and relatively constant speed of the line in applications such as stringing aerial electrical transmission cables. In the installation of aerial electrical transmission cables, for example, it is preferred practice to install or "string" the cables on spaced apart towers using a messenger line or leader attached to the leading end of the cable at one end and wound on a rotary drum type pulling or stringing apparatus at the other end. A relatively constant tension or drag is imposed on the main cable as it is dereeled from a suitable drum as the messenger line pulls the main cable from one support pole or tower to the next. It is desirable to maintain relatively constant tension in the messenger line and the main cable as it is being installed and also to maintain substantially constant line speed to prevent unwanted slack or gathering of the cable during installation and to provide a predetermined tension in the cable. There are also situations wherein the apparatus is used to wind cable on the drum during a destringing operation.

However, with the winding of a flexible cable onto a cylindrical drum, the effective radius or point of tangency of the cable with respect to the drum axis of rotation increases as the amount of cable wound on the drum increases. Accordingly, in order to maintain relatively constant tension on the cable, the torque necessary to rotate the drum must be increased, and the speed of the drum must be decreased in order to maintain relatively constant line speed. Cable stringing apparatus has been developed wherein hydraulic motors are used to drive the cable drum and relatively complex and unreliable mechanical devices are provided to sense the effective pulling radius of the cable as it is wound on the drum in an effort to control the drive motor to maintain constant tension in the cable. Moreover, in many applications for cable stringing apparatus of the type described herein it is desirable to be able to select the maximum tension applied to the cable being strung over a relatively wide range of tension values. In this regard, prior art cable stringing apparatus have been required to be continually monitored and/or several separate controls adjusted to change the cable tension setting for a particular installation.

Accordingly, there has been a strong need to improve the drive system for cable stringing equipment and to provide apparatus which may be selectively set to provide a predetermined substantially constant tension on a cable as the cable or a messenger line is wound onto the drum. Moreover, it has also been very desirable to be able to easily adjust the predetermined constant tension setting for the cable stringing apparatus to accommodate various working applications of the apparatus.

These desiderata have been met with the improved hydraulically operated cable stringing apparatus of the present invention.

SUMMARY OF THE INVENTION

The present invention provides an improved cable stringing apparatus operated by a hydraulic drive system comprising a motor and pump connected in circuit with each other and controllable to provide substantially constant tension in a cable being wound on a rotary drum.

In accordance with one aspect of the present invention there is provided a cable winding apparatus particularly adapted for electrical cable stringing operations and comprising a rotary drum on which a cable or a messenger line is wound in continuous multiple layers or coils while maintaining a substantially constant tension in the line during the winding operation. The cable drum is rotatably driven by a positive displacement hydraulic motor which is adapted to automatically vary its driving torque in accordance with torque demand of the cable drum as the effective radius at which the cable tension force is applied is varied during the winding operation. The hydraulic motor is preferably of a variable displacement type which is operable to adjust its volumetric displacement per revolution of the motor output shaft and its output torque to maintain a relatively constant tension on a flexible line being wound on the rotary drum and to maintain a relatively constant line speed during the winding operation. The hydraulic drive system is also controlled to require substantially constant power input to the cable stringing effort from a prime mover to thereby provide a more efficient stringing operation.

In accordance with another aspect of the present invention there is provided a substantially constant tension cable winding apparatus having a hydraulic drive system including a variable displacement pressure compensated hydraulic pump connected in circuit with a variable displacement hydraulic motor which is controllable to vary volumetric displacement per revolution of the motor output shaft and motor output torque in response to sensing a predetermined pressure of the fluid supplied to the motor inlet port. The predetermined pressure at which motor regulation, i.e. displacement and torque control, commences may be selectively varied by applying a pilot pressure fluid control signal to the motor controller. The pilot pressure signal may be manually adjusted or may be automatically adjusted to vary proportionally to variation in a selected maximum pump delivery pressure. In this way the constant tension setting of the drive system for obtaining a substantially constant tension in the line or cable being wound on the drum may be easily adjusted by adjusting only the pump maximum delivery pressure.

The present invention also contemplates the provision of a hydraulic drive system for a cable stringing apparatus having a drum drive motor of the axial piston, bent axis, variable displacement type and provided with a controller which responds to motor inlet supply pressure and to a pilot pressure signal to effectively maintain constant tension and speed on a flexible cable or messenger line being wound on a rotary drum. The pilot pressure signal is proportionally reduced in response to increasing motor supply pressure by a unique control arrangement including a proportional pressure relief valve for reducing the pilot pressure applied to the controller.

In accordance with still a further aspect of the present invention there is provided a hydraulic pump-motor combination and an associated control system for a constant tension cable stringing apparatus wherein two variable displacement motors may be operated in parallel and supplied with pressure fluid at a predetermined constant pressure from a source such as a single pressure compensated hydraulic pump and wherein a control circuit is provided for selecting the control pressure at which motor displacement will vary to maintain a substantially constant tension and line speed.

The above-noted superior aspects of the present invention as well as other advantages and improved features will be further appreciated by those skilled in the art upon reading the detailed description which follows in conjunction with the drawing.

DESCRIPTION OF THE PREFERRED EMBODIMENTS

Figure 1:
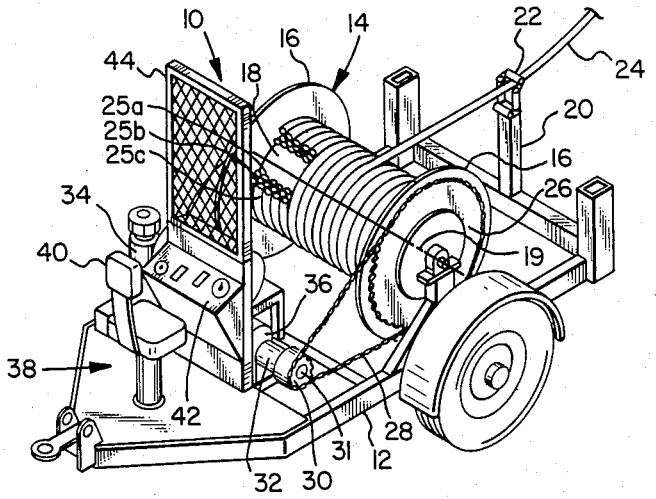
FIG. 1 is a perspective view of a rotary drum type cable winding apparatus for stringing aerial electrical cables and including the hydraulic drive and control system of the present invention.

In the description which follows like parts are marked throughout the specification and drawing with the same reference numerals, respectively. The drawing is not necessarily to scale and conventional symbols have been used for certain hydraulic circuit components in the system diagrams in the interest of clarity and conciseness.

Referring to FIG. 1, there is illustrated an improved cable stringing apparatus which has been adapted to operate with a hydraulic drive and control system of the present invention for maintaining relatively constant tension and relatively constant line speed on a messenger line or on another type of flexible cable being wound on a rotary drum. The apparatus illustrated in FIG. 1 is generally designated by the numeral 10 and is characterized by a portable trailer 12 on which is mounted a relatively large rotary drum 14. The drum 14 has opposed guide or side plates 16 and a generally cylindrical core 18 on which a flexible cable, rope or other elongated line member may be wound by rotating the drum about an axis 19. The drum 14 may be adapted to be used in conjunction with a level wind mechanism such as the mechanism 20 and including a fairlead 22 for guiding a flexible cable or messenger line 24 to wind the cable on the core 18 in a continuous multilayered coil 25*a*, 25*b* and 25*c*. The apparatus 10 may be adapted to interchange the drum 14 with drums of various sizes and adapted to wind different sizes and types of lines.

One side of the drum 14 is suitably drivenly connected to a relatively large diameter sprocket 26 which is engaged with an endless flexible chain 28. The chain 28 is trained around a drive sprocket 30 mounted on the output shaft 31 of a hydraulic motor, generally designated by the numeral 32. The motor 32 is suitably mounted on the trailer 12 and is adapted to be included in a hydraulic circuit to be described in further detail herein. The cable winding apparatus 10 also includes a prime mover such as an internal combustion engine 34 drivably connected to a hydraulic pump 36 which is also hydraulically connected in circuit with the motor 32 in accordance with a hydraulic drive and control system to be described herein. The trailer 12 is also suitably arranged to include an operator control station, generally designated by the numeral 38 including an operator's seat 40 and a control panel 42 adapted to include suitable control levers and instruments for monitoring the operation of the cable winding system. A cable deflecting shield 44 is provided between the operator control panel 42 and the drum 14.

The cable winding apparatus 10 is particularly adapted for reeling or winding a messenger line such as the line 24 onto the drum 14 in pulling an aerial electrical cable along a series of towers or poles, not shown, during installation of the cable and to maintain relatively constant tension in the cable and constant speed of the messenger line and the cable during the installation process. However, as the messenger line 24 is wound onto the cable drum 14, the effective pulling radius of the line increases as additional layers or coils of line are wound onto the core 18 from a minimum pulling radius equivalent to, approximately, the radius of the core 18 with respect to the axis of rotation 19 to a maximum radius which can be assumed to the rim of the guide plate 16 or, if known, the maximum number of layers of line to be wound on the core 18. In order to maintain constant tension on a cable and/or a messenger line being wound on the drum 14, the drive system for the drum must be capable of providing increased driving torque as the effective pulling radius on the drum increases. The drive system must also be operable to reduce the angular velocity of the drum 14 as the pulling radius increases to maintain a substantially constant linear velocity of the messenger line and the cable.

In accordance with the present invention a drive system is provided which accomplishes the desired relatively constant tension and relatively constant line speed by the provision of a motor such as the motor 32 which is of a variable displacement type and which may be operated to increase the volumetric displacement per revolution of its output shaft and increase its output torque at a given motive fluid supply pressure. Accordingly, such a motor operated in conjunction with a hydraulic pump adapted to provide constant or variable fluid flow at a constant supply pressure to the motor may operate the drum 14 in accordance with the desired tension and linear speed characteristics of the line being wound on the drum. However, it is desirable, as previously stated, to be able to provide a drive system for a cable stringing apparatus wherein a relatively wide range of tension or pulling forces may be exerted on the cable and a selected constant pulling force may be maintained when winding or stringing a particular cable or other flexible line member. It is also, of course, desirable to be able to operate the drive system in a reverse mode for dereeling cable or messenger line from the drum 14, at will.

Figure 2:
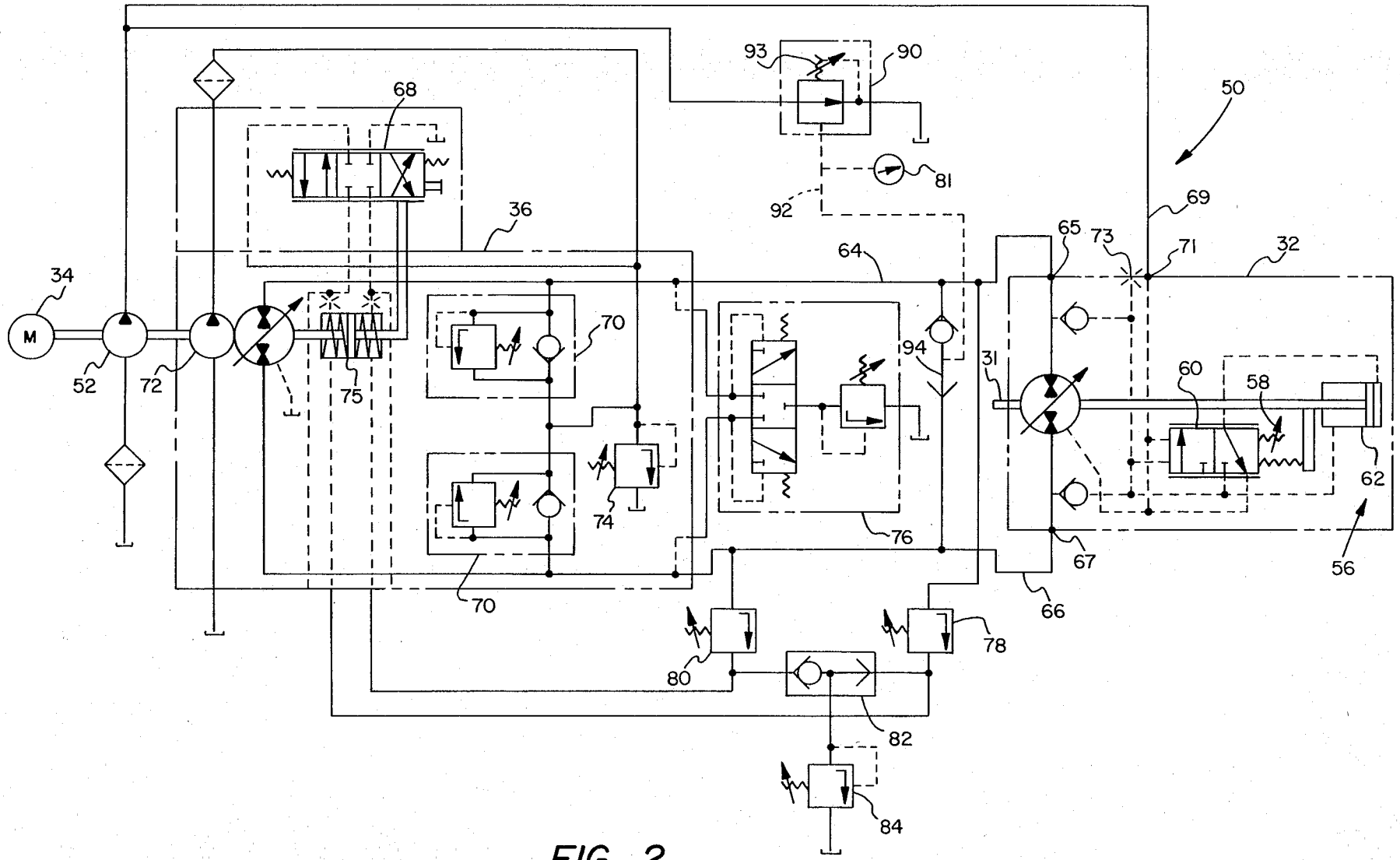
FIG. 2 is a schematic diagram of one embodiment of the hydraulic drive and control system for the apparatus illustrated in FIG. 1.

Referring to FIG. 2, one embodiment of the drive and control system of the present invention is generally designated by the numeral 50 and includes the motor 32, and the drive motor or engine 34 which is drivenly connected to the pump 36. The motor 34 is also suitably drivably connected to a small constant displacement pump 52 as indicated in the diagram of FIG. 2. The motor 32 is of a variable displacement type and typically may comprise an axial piston, bent axis type such as a Model A6V variable displacement motor manufactured by The Rexroth Corporation, Industrial Hydraulics Division, Bethlehem, Pa. The motor 32 is of a type having a controller, generally designated by the numeral 56, which is operable to increase the motor volumetric displacement per revolution of the motor output shaft and the effective output torque of the motor on sensing a change in motor supply pressure and tending to restore the pressure to the set point. The motor supply pressure selected for regulation of motor displacement is obtained by adjusting a biasing spring 58 for a control valve 60 which is operable to control fluid flow to a control actuator 62. The control valve 60 is adapted to sense motor inlet pressure in the high pressure supply line which, for the sake of description herein, will be assumed to be represented by the line 64 when the drive system 50 is being operated to wind cable onto the drum 14. However, the pressure set point at which motor displacement and torque variation commence may be selectively altered by imposing a pilot pressure fluid signal on the valve 60 by way of a pilot control line 69 adapted to receive pressure fluid from the pump 52 as indicated in FIG. 2. The manner of varying the pressure in the line 69 to selectively alter the set point at which regulation of motor displacement and output torque occurs will be described in further detail herein.

Control ports 71 and 73 are provided in the motor 32; however, only the port 71 is used in the control circuit arrangement of FIG. 2, for connecting the pilot pressure signal line 69 to the motor controller 56. The port 73 may be used to interconnect the controller 56 of two or more motors as will be described herein. The supply line 64 is connected to the motor 32 at a port 65 and a main motive fluid return line 66 is connected to a motor port 67. Certain standard components and arrangements including filters, heat exchangers, drain lines and fluid reservoir tanks will not be discussed in detail in the interest of conciseness.

The pump 36, illustrated schematically in FIG. 2, is also of a type commercially available and, in a preferred embodiment of the present invention, comprises an axial piston swashplate type pressure compensated hydraulic pump such as a Model A4V also manufactured by The Rexroth Corporation. The pump 36 is operable to be arranged in a closed circuit for reverse operation with the motor 32 and is connected to the motor via the supply line 64 and the return line 66. The pump 36 also includes a manually actuatable selector valve 68 forming a part of the pump structure and operable to initially move the pump displacement mechanism, including an actuator 75, from a neutral or zero volumetric displacement, non-pumping condition to a condition which will commence delivery of fluid through the line 64 for operation of the motor 32. The pump 36 includes substantially conventional built-in pressure relief valves 70 arranged in circuit with each other to provide for reversible operation of the pump. The pump 36 also includes a built-in charge fluid pump 72 which includes a pressure relief valve 74 in circuit therewith to limit the maximum delivery pressure of the fluid discharged from the pump 72 and fed into the hydraulic circuit by way of the circuitry connecting either one of the pressure relief valves 70 into the lines 64 or 66. The pump 36 also includes low pressure relief valve means 76 for maintaining a minimum charge pressure or return line pressure in the closed loop circuit of the drive system 50. The valve 68, actuator 75, pump 72 and valves 70, 74 and 76 are part of the conventional commercially available pump 36 identified herein.

The pump 36 may be set to deliver hydraulic pressure fluid to the motor 32 at a predetermined maximum pressure as determined by an adjustable pressure relief valve 78 which may be set to valve fluid to the pump displacement control actuator 75 to effectively maintain the pump output pressure delivered to the motor 32 through the line 64 at a predetermined maximum constant value. The complete pump control circuit also preferably includes an adjustable pressure relief or regulator valve 80 which is interconnected with the valve 78 by way of a shuttle valve 82 and a pressure relief valve 84 to minimize or substantially eliminate any sharp pressure pulses from being transmitted to the pump displacement control actuator 75. Accordingly, the maximum discharge pressure of the pump 36 may be controlled by the setting of the valve 78 so that the selected maximum output pressure of the pump in the discharge or supply line 64 may be maintained substantially constant over a wide range of flow of fluid from the pump. Although a pressure compensated pump is preferred for use in the drive system 50 a constant or fixed displacement pump with a pressure relief valve in the discharge fluid line may also be adapted for use with the present invention.

The motor 32 is operable to vary its volumetric displacement per revolution of the motor output shaft and its output torque in accordance with an increase in pressure sensed in the line 64 to maintain the pressure substantially constant. For example, the motor 32 is operable to drive a load at a relatively high speed and low torque in the minimum displacement per revolution position until the pressure in the line 64 reaches the set point sensed by the valve 60 as determined by the spring mechanism 58. If the load on the motor 32 increases as a result of increased pulling radius of the line 24 motor speed will tend to decrease and pressure will increase in the line 64. As a pressure increase is sensed in the line 64, and particularly for the motor 32 at the port 65, the valve 60 is shifted to cause the displacement actuator 62 to move the motor to an increased displacement per revolution position and to produce greater torque. At a constant flow rate in the line 64 motor output shaft speed will decrease in accordance with increase in displacement per revolution and the change in position of the motor axis for the motor of the type described herein will cause an increase in motor output torque for a constant supply pressure. Accordingly, as more line is wound on the drum 14 resulting in the need for slower drum speed and increased driving torque, the motor 32 conveniently moves from a minimum displacement per revolution and minimum torque operating mode toward a greater displacement per revolution and greater torque operating mode to thereby maintain a relatively constant line tension in the line being wound on the drum 14 and also relatively constant line speed. Since motor design characteristics result in greater efficiency at higher displacement settings the actual pulling force or tension may increase from about nine to seventeen percent, depending on working pressure, as the motor moves toward a maximum displacement and maximum torque operating condition. However, this is a favorable condition since, as more capable is strung out on a series of poles, certain forces such as frictional drag on the cable normally increase also.

The pressure at which the valve 60 and the actuator 62 operate to commence regulation of motor displacement per revolution and output torque may be lowered by imposing a pilot pressure control signal on the valve 60 by way of the pilot line 69 and port 71. A preselected ratio for the change in the pilot control or so called override pressure with respect to the control pressure at which motor displacement and torque changes may be selected for a particular motor. The aforementioned type of motor is available with a control which operates in a ratio of 1:16, i.e. 100 psi of pressure applied at the port 71 will lower the set point at which regulation of motor displacement and torque commences by 1600 psi pressure at the motor inlet port 65.

In many applications of the improved cable stringing apparatus of the present invention it is desirable to be able to change selected maximum pulling tension to accommodate different cable sizes or preferred tension settings of the installed cables. Accordingly, it is therefore desirable to be able to change the pilot pressure signal in the line 69 so that the pressure at which motor control or regulation takes effect will change in proportion to the change in the setting of the maximum pressure in line 64 as determined by valve 78. Moreover, it is particularly desirable that only minimum operator effort is required to change the settings of the pressures required to effect control of the motor to maintain a constant preselected tension. Accordingly, by changing the pressure setting in line 64 and reading the setting at gauge 81, FIG. 2, a new setting of substantially constant line tension is obtainable.

In accordance with the present invention the control system for the hydraulic drive arrangement illustrated in FIG. 2 includes an adjustable pressure relief valve, generally designated by the numeral 90, which is in circuit with the pilot pressure control line 69 between the pump 52 and the controller for the motor 32 and is adapted to be set to provide a predetermined pressure in the line 69 to effect a decrease in the pressure set point at which motor displacement and torque output change to maintain a predetermined pulling tension. The relief valve 90 is also adapted to be pilot operated to change the relief setting by way of a pilot pressure fluid control line 92 connected in circuit with the lines 64 and 66 through a shuttle valve 94. The adjustable pressure relief valve 90 may be manually adjusted by a manual actuator 93 and may be automatically adjusted to reduce the pilot pressure signal in line 69 in accordance with a predetermined increase in the pressure in line 64 so that, as the setting of the maximum pressure to be delivered by the pump 36 is increased by the operator, a proportional increase in the pressure set point is obtained at which the displacement per revolution of the motor 32 and the concomitant torque output increase commences. The valve 90 may be substantially similar to a Model 1E11 manufactured by Fluid Controls, Inc. of Mentor, Ohio and adapted to provide the proportional pressure ratio discussed herein.

For the abovementioned ratio of 1:16 for change in pilot control pressure to effect a change in the set point at which motor regulation begins, it is desirable to provide a relief valve 90 which is operable to reduce the pressure in the line 69 in the ratio of 1:16 with respect to the pressure supplied in line 64 or 66. Accordingly, for every unit of pressure increase provided in the line 64 as determined by the pressure setting of the pump 36 a proportional increase in the pressure at which the motor 32 commences to increase its displacement per unit revolution and its output torque is obtained. For example, if it is determined that for a predetermined constant line pull that a pressure of 3200 psi is required at the motor inlet port 65 and in the line 64 a slightly greater pressure, say 3300 psi, is preset by the valve 78 so that the pump 36 will deliver maximum flow at all times to maintain the desired tension. Motor pressure at which regulation begins is normally set slightly below the maximum pump pressure so that it is assured that maximum flow is available from the pump under substantially all operating conditions and that regulation of line speed and tension is accomplished through regulation of the motor displacement and axis angle setting. Accordingly, the pressure at which motor regulation begins is set at 3200 psig, for example, through a suitable adjustment of the setting of the relief valve 90 by way of its actuator 93.

If it is desired to increase the tension or pulling effort exerted by the drum 14, the operator may adjust the maximum pressure setting of the pump by way of the valve 78 to increase the steady state pressure in line 64 to, for example, 4100 psig. If the valve 90 lowers its pressure relief setting 1 psi for every 16 psi increase in the pressure in line 64, the relief setting will be lowered by 50 psi so that for a 4100 psig operating pressure, the pilot control pressure signal in line 69 is lowered by 50 psi and the pressure at which regulation begins in the motor 32 is increased by 800 psi, equal to the increase in the pump operating pressure. Accordingly, a substantially constant tension of a value commensurate with the increased pressure will be maintained throughout the maximum range of regulation of the motor 32 between its minimum displacement per revolution and minimum torque position to its maximum displacement per revolution and maximum torque position. On the other hand if it is desired to lower the pressure setting at which motor regulation begins, i.e. a lower line pull or tension, the valve 78 is set to provide a lower working pressure in line 64 and the relief valve 90 will provide a higher pressure in line 69.

The hydraulic drive and control system described herein in conjunction with FIG. 2 may be operated in a manner which is believed to be readily understandable from the foregoing description. However, briefly, the drive system is operated by operating the engine 34 at a substantially constant speed driving the pump 36 and the pump 52 at constant speed also. The pump 36 may be brought into operation by movement of the selector valve 68 to commence delivery of pressure fluid through line 64 to the motor 32. As pressure increases in line 64 to the set point, as determined by the valve 78, pressure fluid will be valved to the actuator 75 to regulate the output flow from the pump 36. The motor 32 will, of course, commence operation in the minimum displacement per revolution and minimum torque condition and, if the line 24 is only beginning to be wound on the drum 14, the pulling radius will be reduced and, commensurate with motor torque, will produce a predetermined tension in the line 24. Moreover, in the minimum displacement per revolution position, the motor 32 will be operating at a higher rotative speed and driving the drum 14 at a proportionally higher rotative speed. As tension in the line increases to or beyond the maximum set point the increase will be reflected in resistance to motor rotation which will be reflected in a tendency to increase pressure in line 64. However, increasing pressure in line 64 will tend to move valve 60 to effect movement of the actuator 62 to increase motor displacement per revolution and torque thereby reducing motor speed and seeking a balance point at which pressure in line 64 remains substantially constant. The valve 90, of course, has been previously set at the desired setting relative to the setting of the valve 78. As line is wound on the drum 14 the change in effective pulling radius and the circumferential length of the effective drum surface will require further increase in displacement per revolution and increase in torque to maintain relatively constant line tension and relatively constant line speed. This condition is, of course, suitably met with the hydraulic drive system 50.

Figure 3:
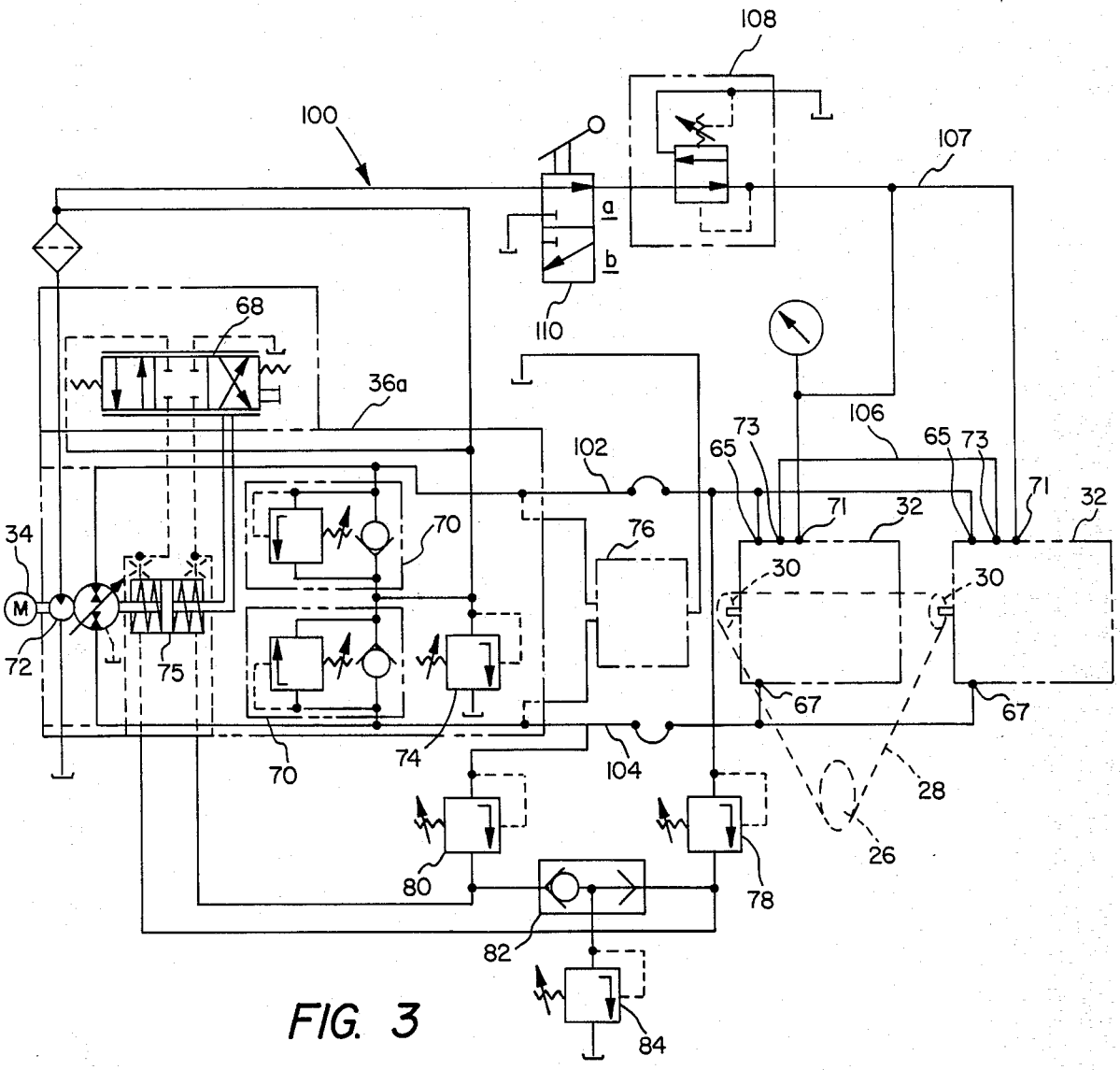
FIG. 3 is a schematic diagram of an alternate embodiment of a hydraulic drive and control system for the apparatus illustrated in FIG. 1.

Referring now to FIG. 3, an alternate embodiment of a hydraulic drive and control system for a cable stringing apparatus is illustrated and generally designated by the numeral 100. The drive system 100 is similar to the drive system 50 except that two motors 32 are connected in parallel relationship to one another hydraulically and are also adapted to be mechanically interconnected to the drive sprocket 26 such as by the chain 28, as indicated schematically. In the drive system 100 a pump **36*a* is provided having essentially all of the components of the pump 36 but preferably being of greater capacity. The pump 36*a* also includes a charge pump 72 which is adapted to supply makeup fluid to the circuit including the pump discharge or fluid supply line 102 and return line 104. The line 102 is connected to the respective motor supply ports 65 of each of the motors 32 and the line 104 is suitably connected to the discharge ports 67 of each of the motors. The control ports 73 of the respective motors 32 are interconnected by a line 106 so that the fluid pressure acting on the respective valves 60 of the motors 32 is equalized. The control ports 71 of the respective motors 32 are connected to a pilot control pressure signal line 107 which is in communication with a self-relieving variable pressure regulator valve, generally designated by the numeral 108. The valve 108 is adapted to be set at a regulated pressure and is connected to the discharge side of the charge pump circuit 72 as indicated by the diagram of FIG. 3. A two position manually actuated valve 110 is provided in the pilot control line 107 between the pump 72 and the pressure regulator valve 108**.

The pump **36*a* is also adapted to be selectively set to operate at a predetermined maximum pressure by selection of the pressure setting for a valve 78 which is in circuit with a valve 80, a shuttle valve 82 and a pressure relief valve 84 in the same manner that these valves are in circuit with the pump 36**.

The operation of the drive system 100 is similar to the drive system 50 except that the pilot control pressure is manually set along with the setting of maximum pump discharge pressure to effect the point at which the respective motors 32 commence to move from a destroked or minimum displacement per revolution position to a maximum displacement per revolution and increased torque output position. Moreover, the pilot pressure signal can be locked out completely by moving the valve 110 from its position a to its position b whereby the pressure at which stroking or increased displacement per revolution of the motors 32 commences will be that which has been preset by the actuators 58 for the valves 60 of the respective motors. The control pressure at which the motors 32 commence increasing their displacement per revolution and their output torque for a given pressure supplied to the respective motors through the line 102 can, of course, be reduced by selectively increasing the pressure supplied by the regulator valve 108 at the control ports 71 of the respective motors.

Although preferred embodiments of the present invention have been described in detail herein those skilled in the art will recognize that various substitutions and modifications may be made to the specific drive systems disclosed and the control circuitry associated therewith without departing from the scope and spirit of the invention as recited in the appended claims.

What I claim is:

1. Apparatus for stringing aerial electrical cables and the like at relatively constant predetermined tension, said apparatus comprising:

a rotary drum rotatably mounted on means for supporting said drum, said drum including a core on which a flexible line such as a messenger line or cable is wound in coils of increasing radius with respect to an axis of rotaion of said drum, and a hydraulic drive system including:

(a) a variable displacement hydraulic motor drivably connected to said drum, said motor including a pressure responsive controller for increasing motor output torque in response to sensing increasing pressure of fluid supplied to said motor from a given supply pressure (b) a pump for supplying pressure fluid to said motor and means for selectively varying the pressure of said fluid delivered to said motor by said pump; and (c) control means for controlling said motor to rotate said drum to increase the driving torque on said drum as said line is wound thereon to maintain said predetermined tension on said line, said control means including means for supplying pilot pressure fluid at a preselected pressure to said controller to decrease the pressure set point at which motor torque is increased in response to a tendency to increase said supply pressure of fluid supplied to said motor, said means for supplying pilot pressure fluid including a proportional pressure relief valve operable to sense increasing fluid supply pressure to said motor and reduce the pressure of said pilot pressure fluid signal to said controller in accordance with the increase in said fluid supply pressure to said motor.

2. The apparatus set forth in claim 1 wherein:

said motor comprises an axial piston bent axis type motor.

3. The apparatus set forth in claim 1 wherein:

said pump comprises a variable displacement pressure compensated pump, and said control means includes means for selectively setting a maximum pump discharge pressure at which pump fluid flow may vary from a maximum to a minimum.

4. The apparatus set forth in claim 3 wherein:

said controller is operable to increase the fluid displacement of said motor per revolution of an output shaft of said motor in response to sensing increasing fluid pressure at said inlet port of said motor, and the maximum pressure setting for said pump is set at a pressure greater than the pressure at which said controller is actuated to increase said displacement of said motor.

5. Apparatus for stringing aerial electrical cables and the like at relatively constant predetermined tension, said apparatus comprising:

a rotary drum rotatably mounted on means for supporting said drum, said drum including a core on which a flexible line such as a messenger line or cable is wound in coils of increasing radius with respect to an axis of rotation of said drum, and a hydraulic drive system including:

(a) a variable displacement hydraulic motor drivably connected to said drum, said motor including a pressure responsive motor controller for increasing motor displacement per revolution and motor output torque in response to sensing increasing pressure of fluid supplied to said motor; and (b) a variable displacement pressure compensated pump, including pump control means for maintaining a maximum pump discharge pressure setting at which pump fluid flow supplied to said motor may vary from a maximum to a minimum which is greater than the pressure at which said motor controller is actuated to increase said displacement of said motor, said pump control means comprising a pressure fluid operated pump displacement controller, and pressure regulator valve means for sensing pump discharge pressure and valving pressure fluid to said pump displacement controller to operate said pump displacement controller to maintain said maximum pump discharge pressure setting.

6. Apparatus for pulling cable at a substantially constant tension by winding one of a portion of said cable or a messenger line connected to said cable around a rotary drum, said apparatus comprising:

a rotary drum including means forming a core portion for receiving said cable thereon in coils of increasing radius with respect to an axis of rotation of said drum; and hydraulic drive means connected to said drum for rotating said drum to wind said cable on said core at a substantially constant tension, said drive means comprising:

(a) a variable displacement hydraulic motor drivably connected to said drum, said motor including a controller responsive to sensing a predetermined fluid pressure of fluid supplied to said motor to increase motor fluid displacement per revolution and motor output torque while winding said cable on said drum to maintain a substantially constant tension in said cable;

(b) a hydraulic pump for supplying pressure fluid to said motor at a substantially constant preselected maximum supply pressure; and (c) control means for selecting said maximum supply pressure and including a pilot pressure control valve operable to change a pilot pressure fluid signal to said controller proportional to a change in said maximum supply pressure selected for changing the pressure setting of said controller at which motor displacement is increased in relation to said preselected maximum supply pressure.

7. Apparatus for pulling cable at a substantially constant tension by winding one of a portion of said cable or a messenger line connected to said cable around a rotary drum, said apparatus comprising:

a rotary drum including means forming a core portion for receiving said cable thereon in coils of increasing radius with respect to an axis of rotation of said drum; and hydraulic drive means connected to said drum for rotating said drum to wind said cable on said core at a substantially constant tension, said drive means comprising:

(a) a variable displacement hydraulic motor drivably connected to said drum, said motor including a controller responsive to sensing a predetermined fluid pressure of fluid supplied to said motor to increase motor fluid displacement per revolution and motor output torque while winding said cable on said drum to maintain a substantially constant tension in said cable;

(b) a hydraulic pump for supplying pressure fluid to said motor at a substantially constant predetermined maximum pressure; and (c) control means for selecting said predetermined maximum pressure and including a pressure regulator valve in communication with a souce of pressure fluid and with said controller for supplying a selected pilot pressure signal to said controller to selectively vary the predetermined pressure setting at which said displacement of said motor is increased in relation to said predetermined maximum pressure.

8. The apparatus set forth in claim 7 wherein:

said source of pressure fluid comprises a fluid charge pump for said pump.

9. The apparatus set forth in claim 7 wherein:

said control means includes a manually actuated valve interposed between said source of pressure fluid and said controller.

* * * * *

UNITED STATES PATENT AND TRADEMARK OFFICE

CERTIFICATE OF CORRECTION

PATENT NO. : 4,508,281

DATED : April 2, 1985

INVENTOR(S) : Robert J. Plater

It is certified that error appears in the above-identified patent and that said Letters Patent is hereby corrected as shown below:

Column 6, line 66, "capable" should be "cable".

Signed and Sealed this

*Fifteenth* Day of *October 1985*

[SEAL]

*Attest:*

DONALD J. QUIGG

*Attesting Officer*

*Commissioner of Patents and Trademarks—Designate*